US011787006B2

(12) United States Patent
Igata

(10) Patent No.: US 11,787,006 B2
(45) Date of Patent: Oct. 17, 2023

(54) SUBSTRATE PROCESSING APPARATUS, POLISHING HEAD, AND SUBSTRATE PROCESSING METHOD

(71) Applicant: TOKYO ELECTRON LIMITED, Tokyo (JP)

(72) Inventor: Toshimitsu Igata, Tokyo (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 173 days.

(21) Appl. No.: 17/314,542

(22) Filed: May 7, 2021

(65) Prior Publication Data

US 2021/0362285 A1 Nov. 25, 2021

(30) Foreign Application Priority Data

May 20, 2020 (JP) ..... 2020-088304

(51) Int. Cl.

| | |
|---|---|
| ***B24B 9/06*** | (2006.01) |
| ***B24B 37/34*** | (2012.01) |
| ***B24B 37/16*** | (2012.01) |
| ***B24B 37/04*** | (2012.01) |
| ***B24B 37/26*** | (2012.01) |
| ***B24B 37/07*** | (2012.01) |

(52) U.S. Cl.

CPC ..... *B24B 9/065* (2013.01); *B24B 37/042* (2013.01); *B24B 37/07* (2013.01); *B24B 37/16* (2013.01); *B24B 37/26* (2013.01); *B24B 37/34* (2013.01)

(58) Field of Classification Search

CPC .. B24B 9/00; B24B 9/065; B24B 9/06; B24B 9/005; B24B 37/042; B24B 37/07; B24B 37/16; B24B 37/26; B24B 37/34; H01L 21/02087

See application file for complete search history.

(56) References Cited

U.S. PATENT DOCUMENTS 6,913,520 B1 * 7/2005 Liao ..... B24B 37/042 451/63
2019/0157071 A1 * 5/2019 Peng ..... H01L 21/30625

FOREIGN PATENT DOCUMENTS

| | | | | |
|---|---|---|---|---|
| CN | 1674224 A | * | 9/2005 | ..... H01L 21/00 |
| CN | 110450018 A | * | 11/2019 | ..... B24B 19/06 |
| CN | 110919485 A | * | 6/2021 | ..... B24B 27/00 |
| GB | 2318998 A | * | 5/1998 | ..... B24B 37/04 |
| JP | 2012-182507 A | | 9/2012 | |
| JP | 2012182507 A | * | 9/2012 | ..... H01L 21/304 |

(Continued)

OTHER PUBLICATIONS

English translation of CN 1674224A (Year: 2005).*

(Continued)

*Primary Examiner* — Joel D Crandall
*Assistant Examiner* — Sukwoo James Chang
(74) *Attorney, Agent, or Firm* — Nath, Goldberg & Meyer; Jerald L. Meyer; Tanya E. Harkins

(57) ABSTRACT

A substrate processing apparatus includes: a holding portion configured to hold a substrate including a bevel and an end surface in a peripheral edge portion of the substrate; a rotator configured to rotate the holding portion; a polishing head configured to be brought into contact with the peripheral edge portion of the substrate held by the holding portion and to polish the peripheral edge portion of the substrate; and a holder to which the polishing head is installed.

14 Claims, 13 Drawing Sheets

(56) References Cited

FOREIGN PATENT DOCUMENTS

| | | | | | |
|---|---|---|---|---|---|
| KR | 20110077314 | | * | 7/2011 | ..... H01L 21/304 |
| WO | WO2006049269 | A1 | * | 11/2006 | ..... B24B 37/04 |
| WO | WO2009154075 | A1 | * | 12/2009 | ..... H01L 21/67046 |

OTHER PUBLICATIONS

English translation of WO 2009154075A1 (Year: 2009).*
English translation of KR 20110077314 (Year: 2011).*
English translation of JP 2012182507A (Year: 2012).*
English translation of CN 110450018A (Year: 2019).*
English translation of CN 110919485A (Year: 2021).*

* cited by examiner

SUBSTRATE PROCESSING APPARATUS, POLISHING HEAD, AND SUBSTRATE PROCESSING METHOD

CROSS-REFERENCE TO RELATED APPLICATION

This application is based upon and claims the benefit of priority from Japanese Patent Application No. 2020-088304, filed on May 20, 2020, the entire contents of which are incorporated herein by reference.

TECHNICAL FIELD

The present disclosure relates to a substrate processing apparatus, a polishing head, and a substrate processing method.

BACKGROUND

The substrate cleaning apparatus described in Patent Document 1 includes a brush made of a sponge-like resin and configured to clean the peripheral edge of a substrate. The brush removes deposits adhering to the peripheral edge of a substrate.

PRIOR ART DOCUMENT

Patent Document

Patent Document 1: Japanese Laid-Open Patent Publication No. 2012-182507

SUMMARY

According to one embodiment of the present disclosure, there is provided a substrate processing apparatus including; a holding portion configured to hold a substrate including a bevel and an end surface in a peripheral edge portion of the substrate; a rotator configured to rotate the holding portion; a polishing head configured to be brought into contact with the peripheral edge portion of the substrate held by the holding portion and to polish the peripheral edge portion of the substrate; and a holder to which the polishing head is installed.

BRIEF DESCRIPTION OF DRAWINGS

The accompanying drawings, which are incorporated in and constitute a part of the specification, illustrate embodiments of the present disclosure, and together with the general description given above and the detailed description of the embodiments given below, serve to explain the principles of the present disclosure.

DETAILED DESCRIPTION

Figure 1:
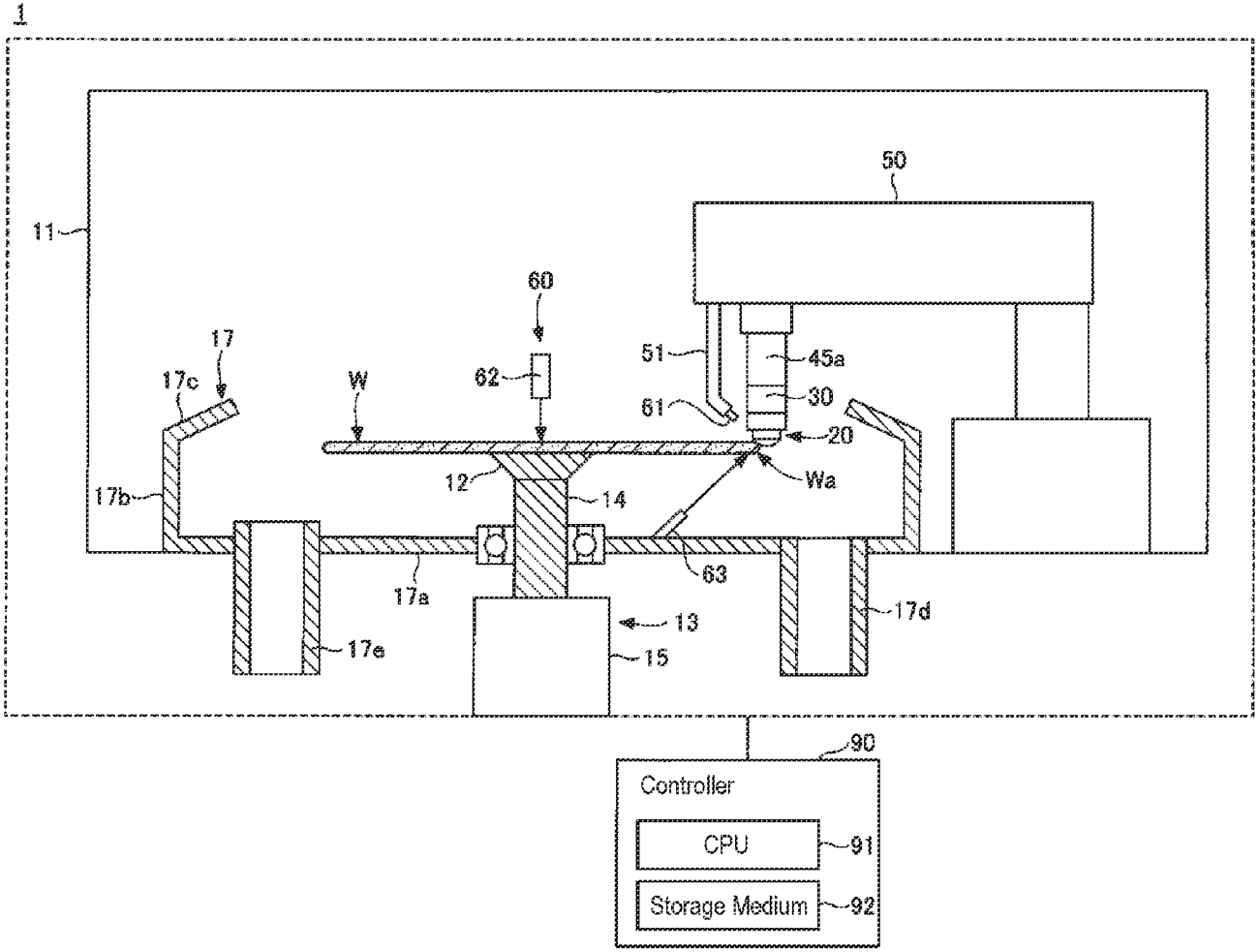
FIG. 1 is a cross-sectional view of a substrate processing apparatus according to an embodiment.

Reference will now be made in detail to various embodiments, examples of which are illustrated in the accompanying drawings. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, systems, and components have not been described in detail so as not to unnecessarily obscure aspects of the various embodiments. In addition, in each drawing, the same or corresponding components may be denoted by the same reference numerals, and a description thereof may be omitted.

First, a substrate processing apparatus 1 will be described with reference to FIG. 1. The substrate processing apparatus 1 processes a substrate W. The substrate W is a silicon wafer in this embodiment, but may be a compound semiconductor wafer or a glass substrate. A device such as an electronic circuit is formed on the surface of the substrate W, and a conductive film, an insulating film, a photoresist film, or the like is formed on the surface of the substrate W. Multiple films may be formed. The substrate processing apparatus 1 includes a processing container 11 configured to accommodate therein a substrate W, a holding portion 12 configured to hold the substrate W, and a rotator 13 configured to rotate the holding portion 12.

The processing container 11 includes agate (not illustrated) and agate valve (not illustrated) configured to open and close the gate. The substrate W is carried into the processing container 11 through the gate, processed inside the processing container 11, and then carried out of the processing container 11 through the gate.

The holding portion 12 holds, for example, the substrate W horizontally. The holding portion 12 holds the substrate W horizontally such that the surface of the substrate W on which a device is formed is oriented upward and the center of the top surface of the substrate W coincides with the rotation center line of a rotation shaft 14. The holding portion 12 is a vacuum chuck in this embodiment, but may be a mechanical chuck, an electrostatic chuck, or the like. The holding portion 12 may be a rotatable spin chuck.

The rotator 13 includes, for example, the vertical rotation shaft 14 and a rotation motor 15 configured to rotate the rotation shaft 14. The rotational driving force of the rotation motor 15 may be transmitted to the rotation shaft 14 via a rotation transmission mechanism such as a timing belt or a gear. When the rotation shaft 14 is rotated, the holding portion 12 is also rotated.

The substrate processing apparatus 1 includes a cup 17 configured to collect a cleaning liquid or the like supplied to the substrate W. The cup 17 surrounds the peripheral edge of the substrate W held by the holding portion 12, and receives the cleaning liquid or the like scattered from the peripheral edge of the substrate W. Although the cup 17 does not rotate with the rotation shaft 14 in this embodiment, the cup 17 may rotate with the rotation shaft 14.

The cup 17 includes a horizontal bottom wall 17*a*, an outer peripheral wall 17*b* extending upward from the peripheral edge of the bottom wall 17*a*, and an inclined wall 17*c* extending diagonally upward from the upper end of the outer peripheral wall 17*b* toward the inside of the outer peripheral wall 17*b* in the radial direction. The bottom wall 17*a* is provided with a drainage pipe 17*d* configured to discharge the liquid accumulated inside the cup 17 and an exhaust pipe 17*e* configured to discharge the gas accumulated inside the cup 17.

The substrate processing apparatus 1 includes a polishing head 20. The polishing head 20 is brought into contact with a peripheral edge portion Wa of the substrate W held by the holding portion 12 to polish the peripheral edge portion Wa of the substrate W. The polishing head 20 is capable of scraping off strong deposits such as an unnecessary film deposited on the peripheral edge portion Wa of the substrate W. Therefore, it is possible to effectively remove the deposits compared with the case in which the peripheral edge portion Wa of the substrate W is cleaned with a sponge-like brush.

Figure 2:
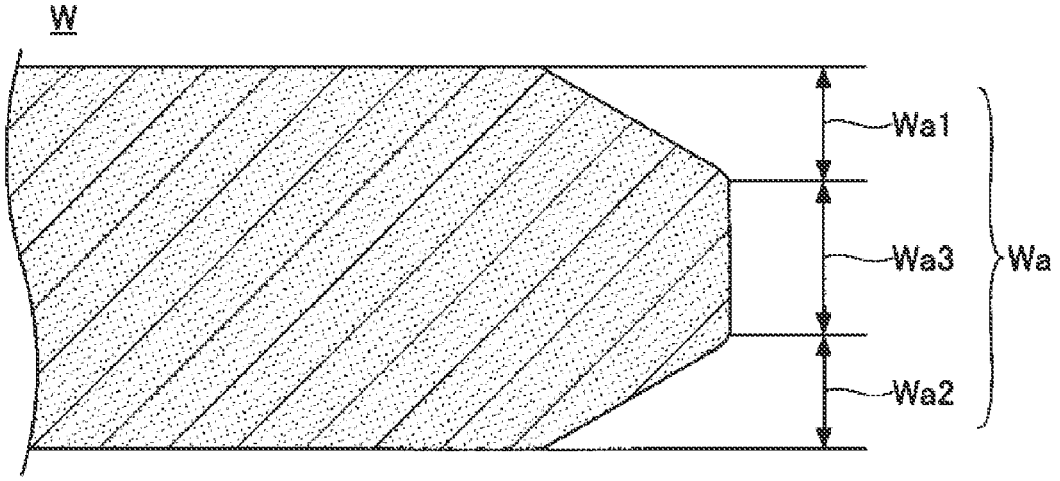
FIG. 2 is a cross-sectional view illustrating an exemplary peripheral edge of a substrate.

For example, as illustrated in FIG. 2, the peripheral edge portion Wa of the substrate W includes a first bevel Wa1, a second bevel Wa2, and an end surface Wa3. The first bevel Wa1 is inclined downward from the peripheral edge of the top surface of the substrate W toward the outside in the radial direction of the substrate W. Meanwhile, the second bevel Wa2 is inclined upward from the peripheral edge of the bottom surface of the substrate W toward the outside in the radial direction of the substrate W. The end surface Wa3 is formed vertically between the first bevel Wa1 and the second bevel Wa2. The end surface Wa3 is also called an "apex".

Figure 3:
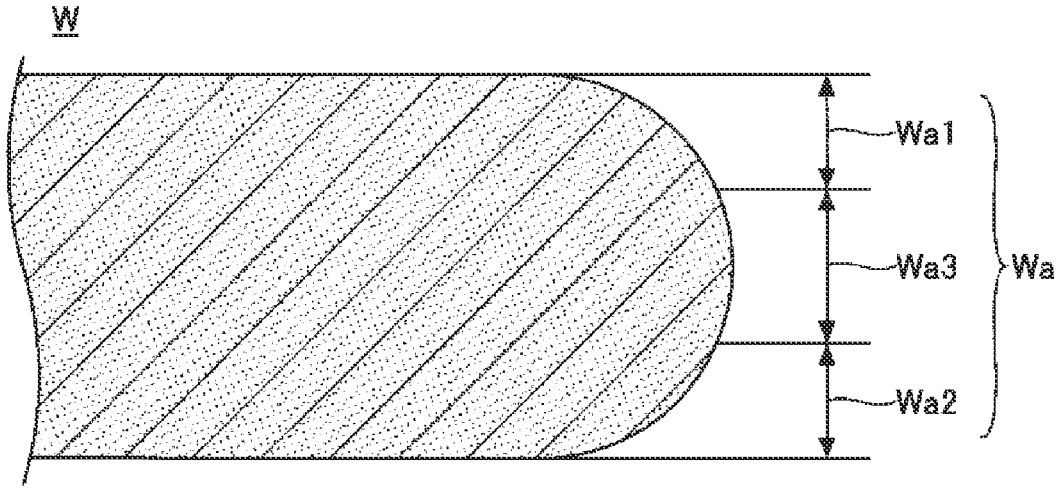
FIG. 3 is a cross-sectional view illustrating a modification of a peripheral edge of a substrate.

As illustrated in FIG. 2, each of the first bevel Wa1, the second bevel Wa2, and the end surface Wa3 has a linear shape in a cross-sectional view. However, as illustrated in FIG. 3, each of the first bevel Wa1, the second bevel Wa2, and the end surface Wa3 may have a curved shape in a cross-sectional view. The polishing head 20 polishes at least one of the first bevel Wa1 and the end surface Wa3.

Figure 6A:
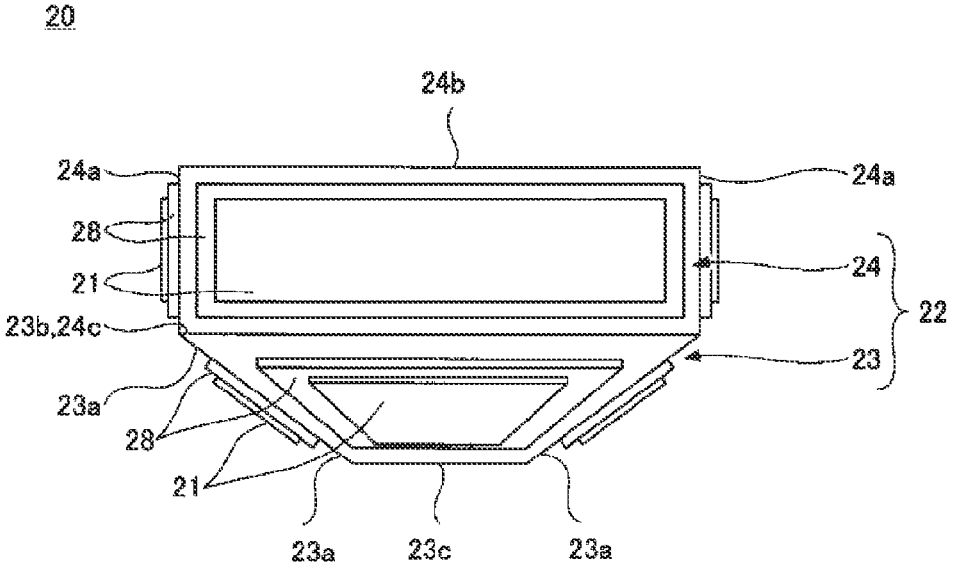
FIG. 6A is a side view of a polishing head according to an embodiment.
Figure 6B:
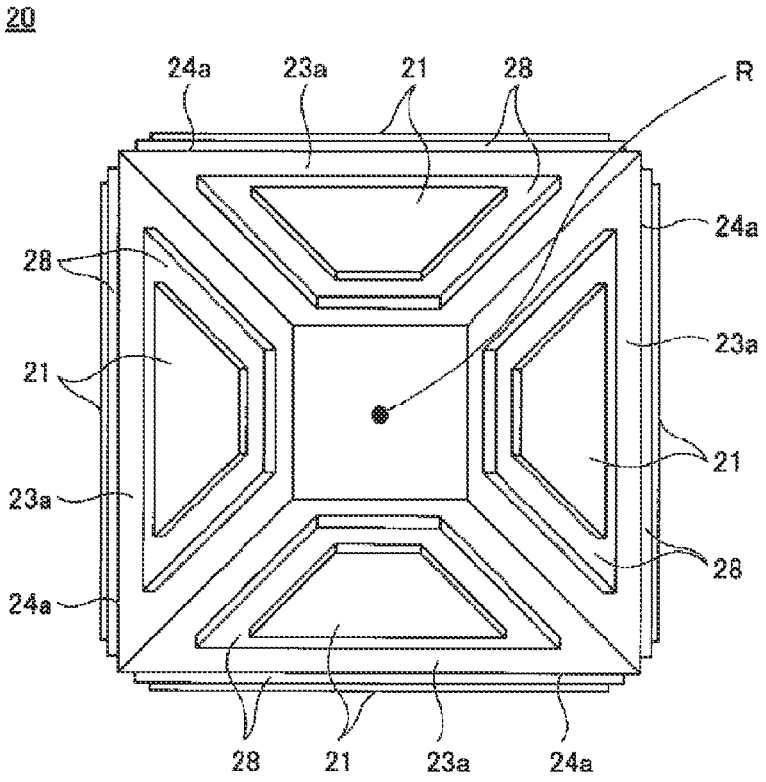
FIG. 6B is a bottom view of the polishing head illustrated in FIG. 6A.

For example, as illustrated in FIGS. 6A and 6B, the polishing head 20 includes a polishing sheet 21 containing abrasive grains and a polishing block 22 including a flat surface on which the polishing sheet 21 is fixed. The polishing sheet 21 includes, for example, an abrasive material layer in which abrasive grains such as diamond abrasive grains are hardened with a resin, and a resin film which supports the polishing material layer. The abrasive material layer may have a convex-concave pattern on the surface thereof in order to suppress clogging. The polishing block 22 is made of a hard resin such as polyvinyl chloride (PVC).

The polishing sheet 21 is fixed to the flat surface of the polishing block 22, and is brought into contact with the peripheral edge portion Wa of the substrate W. When the polishing sheet 21 is fixed to a flat surface, unlike the case where the polishing sheet 21 is fixed to a curved surface, it is possible to fix the polishing sheet 21 as it is without deforming the same. Therefore, it is possible to use a polishing sheet 21 having a high hardness so that deposits can be effectively removed.

Figure 7A:
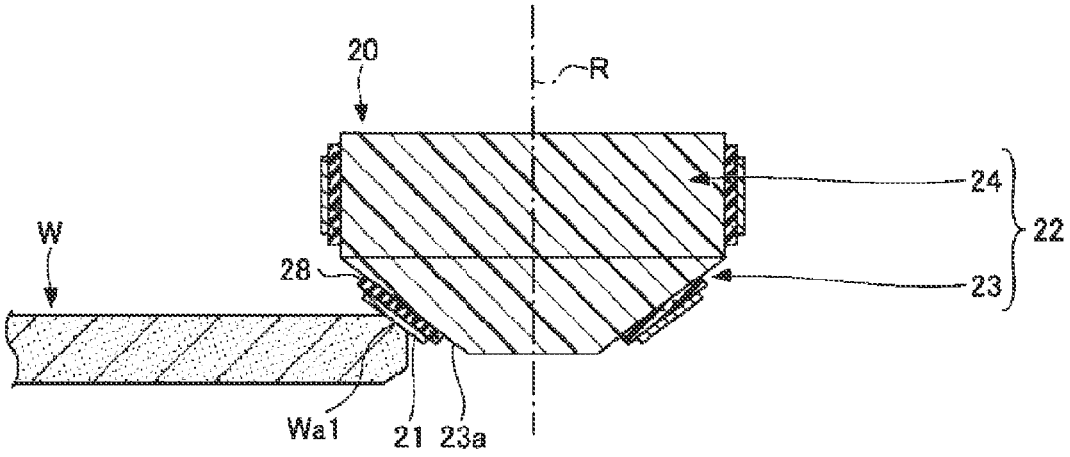
FIG. 7A is a cross-sectional view illustrating an example of polishing the first bevel illustrated in FIG. 2.
Figure 8A:
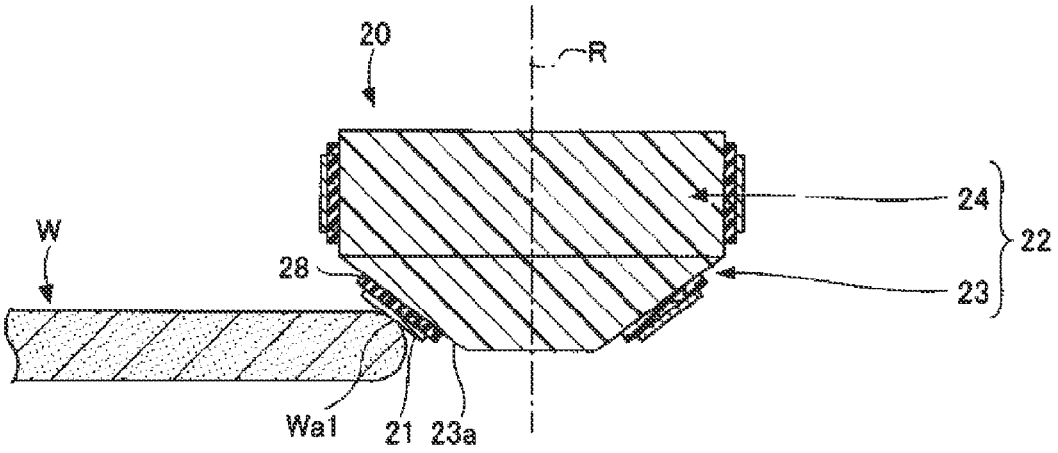
FIG. 8A is a cross-sectional view illustrating an example of polishing the first bevel illustrated in FIG. 3.

The polishing block 22 has, for example, a pyramid 23. The pyramid 23 is tapered downward. The pyramid 23 includes pyramid surfaces 23*a*, a horizontal top surface 23*b*, and a horizontal bottom surface 23*c*. Thus, the pyramid 23 may be a truncated pyramid obtained by removing a tip end of a pyramid. The pyramid surfaces 23*a* are arranged diagonally downward. The polishing sheet 21 is fixed to each of the pyramid surfaces 23*a* of the pyramid 23, and, as illustrated in FIG. 7A or FIG. 8A, polishes the first bevel Wa1 of the substrate W.

Figure 7B:
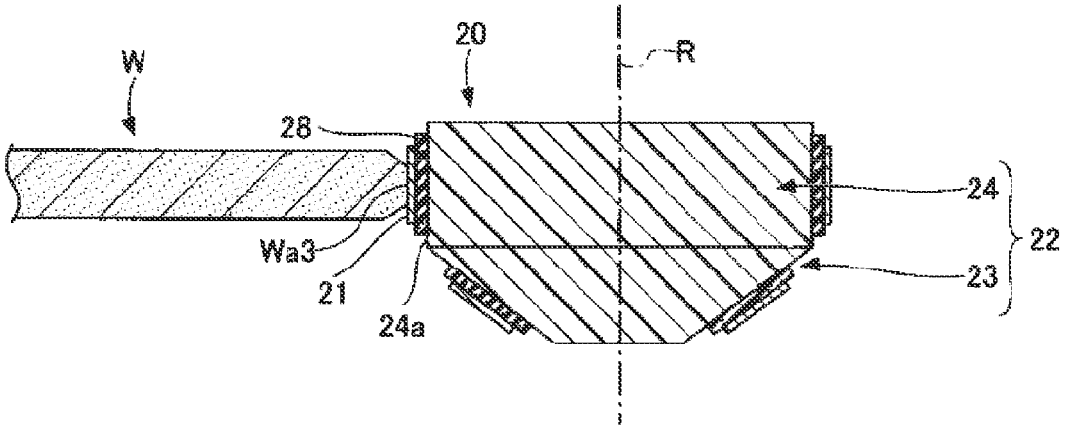
FIG. 7B is a cross-sectional view illustrating an example of polishing the end surface illustrated in FIG. 2.
Figure 8B:
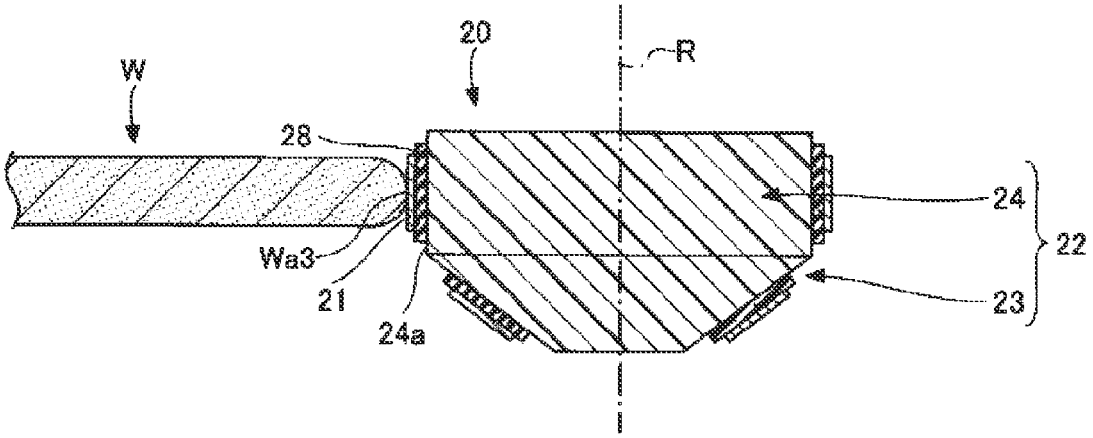
FIG. 8B is a cross-sectional view illustrating an example of polishing the end surface illustrated in FIG. 3.

The polishing block 22 may have a prismatic body 24. The prismatic body 24 is arranged on, for example, the pyramid 23. The prismatic body 24 includes side surfaces 24*a*, a horizontal top surface 24*b*, and a horizontal bottom surface 24*c*. The side surfaces 24*a* are disposed vertically. The bottom surface 24*c* of the prismatic body 24 and the top surface 23*b* of the pyramid 23 have the same shape and the same dimensions, but may have different shapes or dimensions. The polishing sheet 21 is fixed to each of the side surfaces 24*a* of the prismatic body 24, and, as illustrated in FIG. 7B or FIG. 8B, polishes the end surface Wa3 of the substrate W.

Figure 5A:
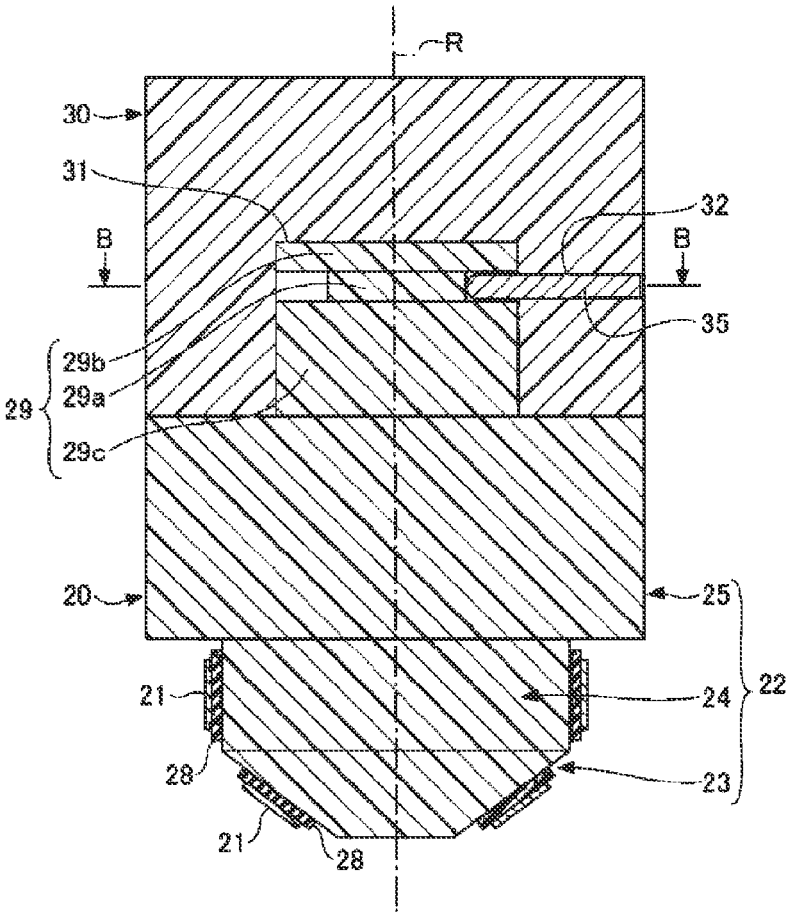
FIG. 5A is a cross-sectional view illustrating an exemplary fixture.

In addition, the polishing block 22 may have a cylindrical body 25 (see, for example, FIG. 5A). The cylindrical body 25 is arranged on the prismatic body 24. The cylindrical body 25 is attached to a holder 30. When there is no cylindrical body 25, the prismatic body 24 is attached to the holder 30. When there is no prismatic body 24, the pyramid 23 is attached to the holder 30.

The holder 30 is made of a hard resin such as poly ether ether ketone (PEEK). The holder 30 may be rotatable as described later. The polishing block 22 is rotated together with the holder 30.

When the polishing sheets 21 are fixed to the flat surfaces of the polishing block 22, the rotation of the holder 30 is stopped such that the polishing block 22 does not rotate during the polishing of the substrate W. The purpose of stopping the rotation of the holder 30 during polishing of the substrate W is to maintain a constant distance between the rotation center of the substrate W and the polishing sheets 21.

Figure 12A:
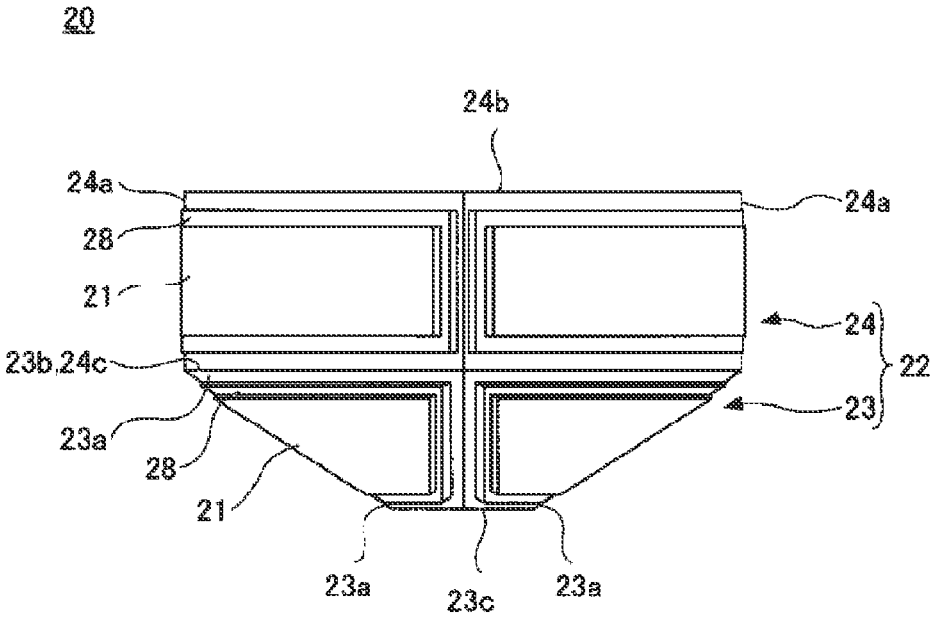
FIG. 12A is a side view of a polishing head according to a first modification.
Figure 12B:
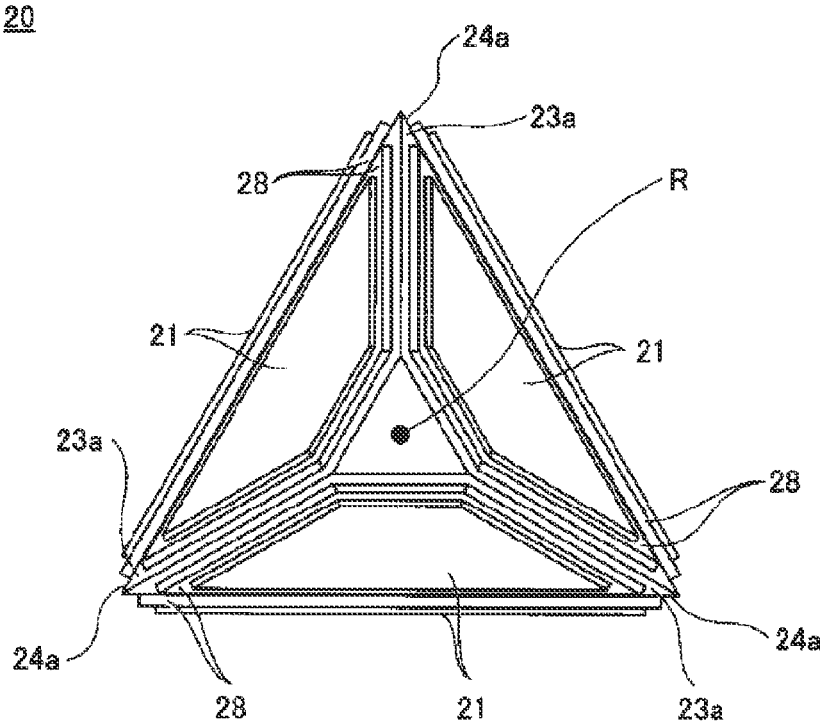
FIG. 12B is a bottom view of the polishing head illustrated in FIG. 12A.

The pyramid 23 is, for example, a square pyramid as illustrated in FIGS. 6A and 6B, and includes pyramid surfaces 23*a* arranged rotationally symmetrically about the rotation center line R of the holder 30. The pyramid 23 may be a regular polygonal pyramid, and may be, for example, a regular triangular pyramid as illustrated in FIGS. 12A and 12B.

The polishing sheets 21 are fixed to the pyramid surfaces 23*a*, and are arranged rotationally symmetrically about the rotation center line R of the holder 30. When one polishing sheet 21 is worn and the life of the same expires, it is possible to polish the first bevel Wa1 of the substrate W using another polishing sheet 21 by rotating the holder 30 without replacing the polishing head 20, and thus it is possible to replace the polishing sheet 21 to be applied to the first bevel Wa1.

The prismatic body 24 is, for example, a regular square column as illustrated in FIGS. 6A and 6B, and includes side surfaces 24*a* arranged rotationally symmetrically about the rotation center line R of the holder 30. The prismatic body 24 may be a regular polygonal column, and may be, for example, a regular triangular column as illustrated in FIGS. 12A and 12B.

The polishing sheets 21 are fixed to the side surfaces 24*a*, and are arranged rotationally symmetrically about the rotation center line R of the holder 30. When one polishing sheet 21 is worn and the life of the same expires, it is possible to polish the end surface Wa3 of the substrate W using another polishing sheet 21 by rotating the holder 30 without replacing the polishing head 20, and thus it is possible to replace the polishing sheet 21 to be applied to the end surface Wa3.

Figure 13A:
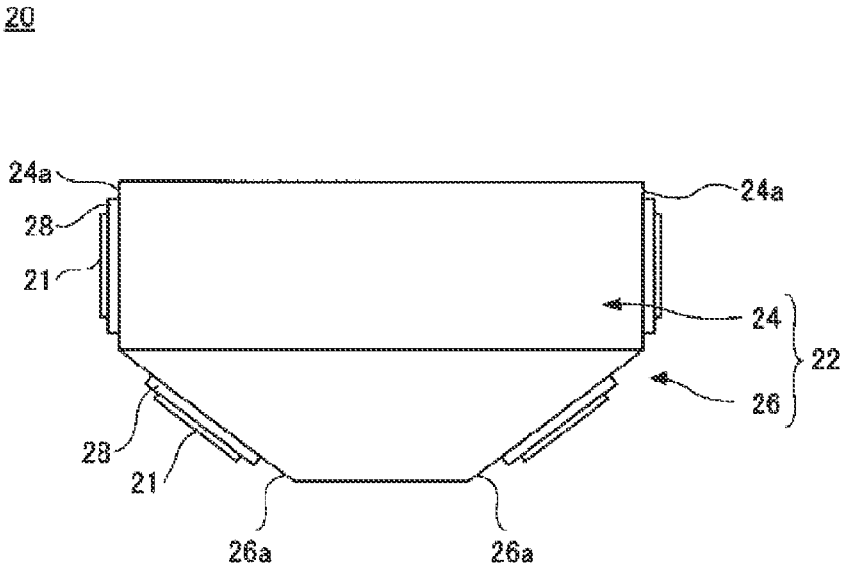
FIG. 13A is a side view of a polishing head according to a second modification.
Figure 13B:
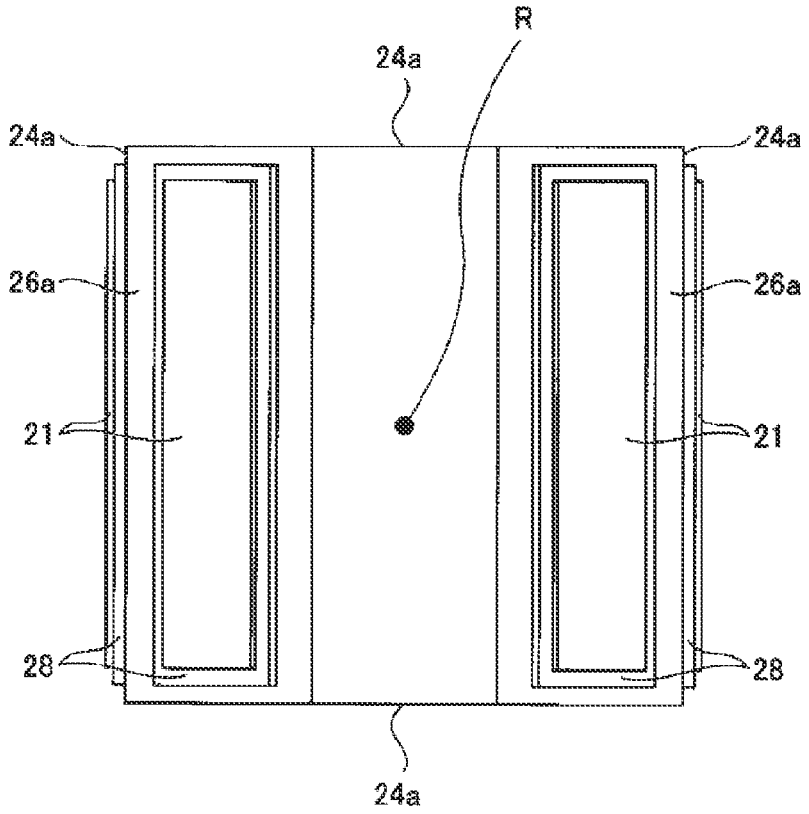
FIG. 13B is a bottom view of the polishing head illustrated in FIG. 13A.

The polishing block 22 does not have to have a regular polygonal pyramid, a regular polygonal column, or the like. For example, as illustrated in FIGS. 13A and 13B, the polishing block 22 may have a wedge-shaped body 26 obtained by making a pair of side surfaces of a square column diagonally inclined. The wedge-shaped body 26 includes a pair of tapered surfaces 26*a* arranged rotationally symmetrically about the rotation center line R of the holder 30. The pair of tapered surfaces 26*a* are tapered downward and are oriented diagonally downward.

The polishing sheets 21 are fixed to a pair of tapered surfaces 26*a*, and are arranged rotationally symmetrically about the rotation center line R of the holder 30. When one polishing sheet 21 is worn and the life of the same expires, it is possible to polish the first bevel Wa1 of the substrate W using another polishing sheet 21 by rotating the holder 30 without replacing the polishing head 20, and thus it is possible to replace the polishing sheet 21 to be applied to the first bevel Wa1.

As illustrated in FIG. 13B, the polishing sheets 21 may be fixed only to a pair of side surfaces 24*a* of the prismatic body 24, and may not be fixed to the remaining pair of side surfaces 24*a*. The side surfaces 24*a* of the prismatic body 24 to which the polishing sheets 21 are fixed and the tapered surfaces 26*a* of the wedge-shaped body 26 to which the polishing sheets 21 are fixed are arranged at the same angle around the rotation center line R of the holder 30. In the state in which the rotation of the holder 30 is stopped, it is possible to polish the first bevel Wa1 and the end surface Wa3 of the substrate W one after another.

The polishing block 22 may have one or more flat surfaces on each of which the polishing sheet 21 is fixed, and may not have to have multiple flat surfaces. As described above, when the polishing sheet 21 is fixed to a flat surface, it is possible to use a polishing sheet 21 having a high hardness so that deposits can be effectively removed. Therefore, the flat surfaces do not have to be arranged rotationally symmetrically about the rotation center line R of the holder 30.

Figure 14A:
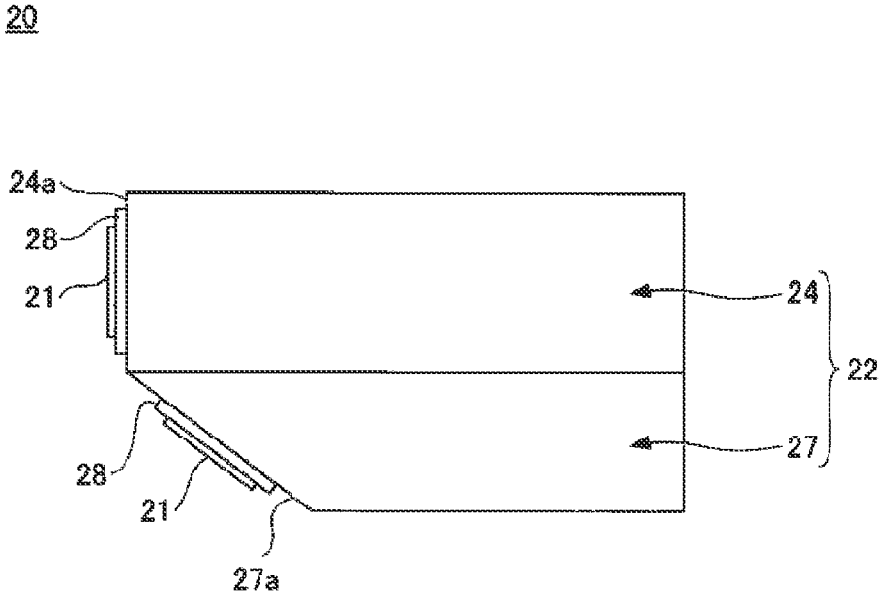
FIG. 14A is a side view of a polishing head according to a third modification.
Figure 14B:
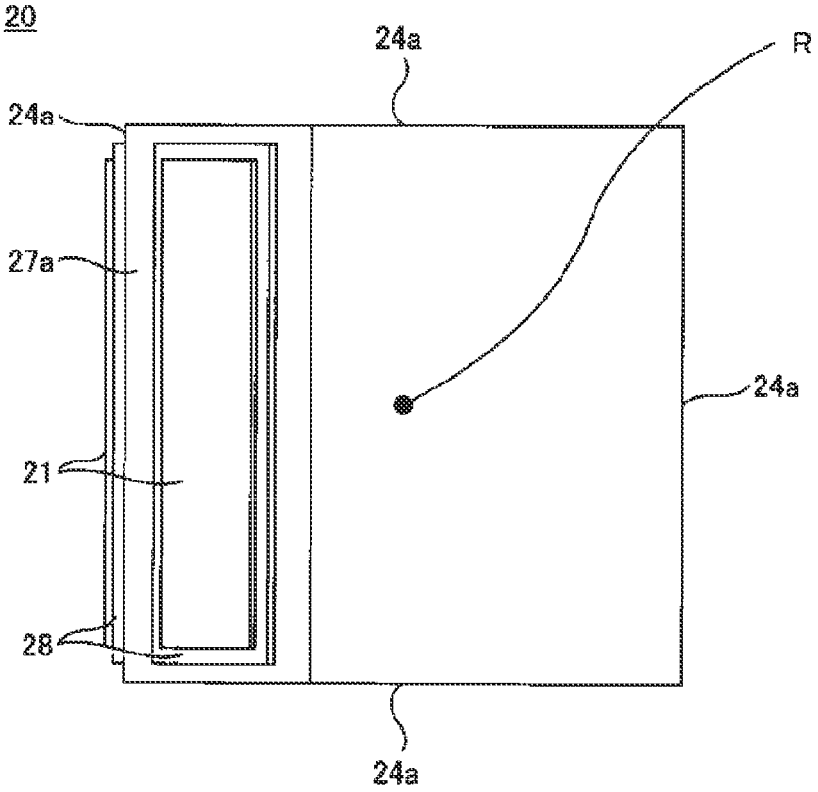
FIG. 14B is a bottom view of the polishing head illustrated in FIG. 14A.

For example, as illustrated in FIGS. 14A and 14B, the polishing block 22 may have a solid body 27 obtained by making one side surface of a square pillar diagonally inclined. The solid body 27 includes an inclined surface 27*a* oriented diagonally downward. A polishing sheet 21 is disposed on the inclined surface 27*a*.

As illustrated in FIG. 14B, the polishing sheet 21 may be fixed only on side surface 24*a* of the prismatic body 24, and may not be fixed to the remaining three side surfaces 24*a*. The side surface 24*a* of the prismatic body 24 to which the polishing sheet 21 is fixed and the inclined surface 27*a* of the solid body 27 to which the polishing sheet 21 is fixed are arranged at the same angle around the rotation center line R of the holder 30. In the state in which the rotation of the holder 30 is stopped, it is possible to polish the first bevel Wa1 and the end surface Wa3 of the substrate W one after another.

The polishing head 20 may further include flexible sheets 28 arranged between the polishing sheets 21 and the polishing block 22. The flexible sheets 28 are formed of a sponge-like resin, for example, a polyvinyl alcohol (PVA) sponge. The flexible sheets 28 are deformed following the shape of the peripheral edge portion Wa of the substrate W, and bring the polishing sheets 21 into close contact with the peripheral edge portion Wa of the substrate W.

Figure 5B:
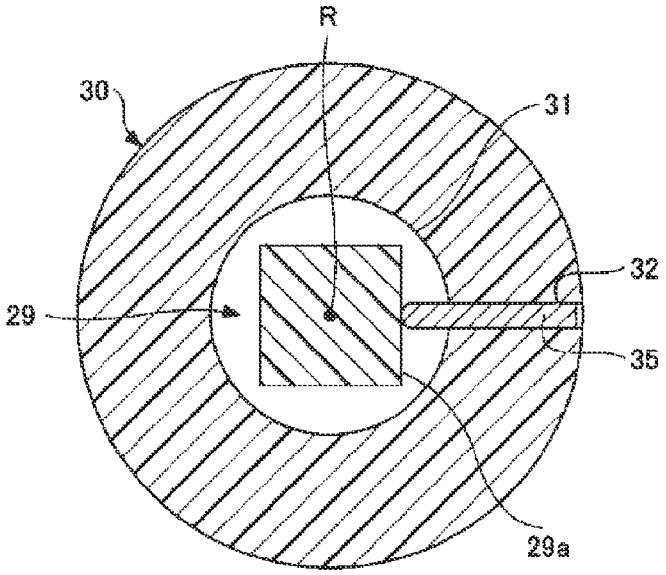
FIG. 5B is a cross-sectional view taken along line B-B in FIG. 5A.

As illustrated in FIGS. 5A and 5B, the substrate processing apparatus 1 includes the holder 30 to which the polishing head 20 is installed. For example, the polishing block 22 is attached to the bottom surface of the holder 30. A concave portion 31 is formed on the bottom surface of the holder 30, a convex portion 29 is formed on the top surface of the polishing block 22, and the convex portion 29 and the concave portion 31 are fitted to each other.

The substrate processing apparatus 1 includes a fixture 35 so as to replaceably attach the polishing head 20 to the holder 30. The fixture 35 is, for example, a set screw, and is screwed into a screw hole 32 in the holder 30 and pressed against the side surface of a square column 29*a* of the convex portion 29. The square column 29*a* is capable of suppressing rotational deviation compared with a cylindrical column. Therefore, it is possible to suppress the rotational deviation of the polishing head 20.

In addition to the square column 29*a*, the convex portion 29 of the polishing head 20 has a disk-shaped upper flange 29*b* installed at the upper end of the square column 29*a* and a disk-shaped lower flange 29*c* installed at the lower end of the square column 29*a*. Each of the diameter of the upper flange 29*b* and the diameter of the lower flange 29*c* is smaller than the diameter of the concave portion 31.

When replacing the polishing head 20, first, the set screw is retracted from the concave portion 31. Next, the convex portion 29 of the used polishing head 20 is pulled out from the concave portion 31 of the holder 30. Thereafter, the convex portion 29 of an unused polishing head 20 is fitted into the concave portion 31 of the holder 30. Subsequently, the set screw is screwed in and pressed against the side surface of the square column 29*a* of the convex portion 29.

Figure 4:
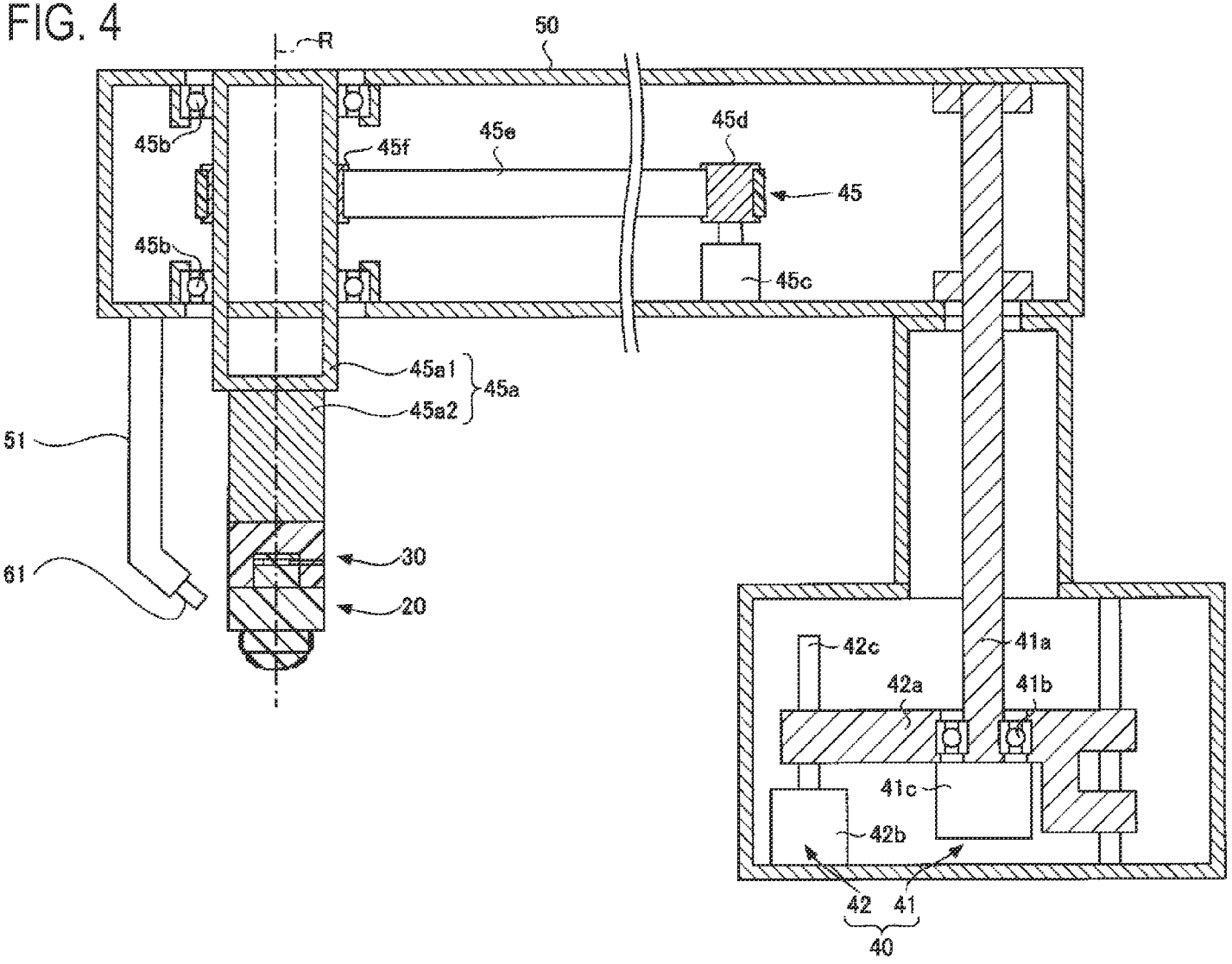
FIG. 4 is a cross-sectional view illustrating a moving mechanism.

As illustrated in FIG. 4, the substrate processing apparatus 1 includes a moving mechanism 40 configured to move the holder 30 between a polishing position and a standby position. As illustrated in FIG. 1, the polishing position is a position at which the polishing head 20 is brought into contact with the peripheral edge portion Wa of the substrate W. Although not illustrated, the standby position is a position for preventing interference between the substrate W and the polishing head 20 when the substrate W is carried in and out. The standby position is set outside the polishing position in the radial direction of the substrate W.

As illustrated in FIG. 4, the moving mechanism 40 has a horizontal moving part 41 configured to move the holder 30 in the horizontal direction. The horizontal moving part 41 includes, for example, a vertical rotation shaft 41*a*, a bearing 41*b* of the rotation shaft 41*a*, and a motor 41*c* configured to rotate the rotation shaft 41*a*. The rotation shaft 41*a* and the holder 30 are connected via a horizontal arm 50. The arm 50 is fixed to the upper end of the rotation shaft 41*a*. When the rotation shaft 41*a* is rotated by the motor 41*c*, the holder 30 is turned around the rotation shaft 41*a*.

The horizontal moving part 41 moves the holder 30 in the radial direction of the substrate W held by the holding portion 12. Although not illustrated, the horizontal moving part 41 includes a horizontal guide rail, a motor configured to move the arm 50 in the longitudinal direction of the guide rail, and a ball screw configured to convert the rotational motion of the motor into the linear motion of the arm 50. When the arm 50 is moved, the holder 30 is moved.

The moving mechanism 40 has a vertical moving part 42 configured to move the holder 30 in the vertical direction. The vertical moving part 42 includes, for example, an elevation board 42*a*, a motor 42*b* configured to raise and lower the elevation board 42*a*, and a ball screw 42*c* configured to convert the rotational motion of the motor 42*b* into the linear motion of the elevation board 42*a*. The elevation board 42*a* holds the motor 41*c* of the horizontal moving part 41 and also holds the bearing 41*b* of the rotation shaft 41*a*. When the elevation board 42*a* is raised and lowered, the arm 50 is raised and lowered, and as a result, the holder 30 is raised and lowered.

The substrate processing apparatus 1 may include a rotation mechanism 45 configured to rotate the holder 30. When one polishing sheet 21 is worn and the life of the same expires, it is possible to automatically rotate the holder 30, and thus it is possible to polish the substrate W using another polishing sheet 21. Thus, it is possible to replace the polishing sheet 21 to be applied to the substrates W.

The rotation mechanism 45 includes, for example, a vertical rotation shaft 45*a*, a bearing 45*b* of the rotation shaft 45*a*, and a motor 45*c* configured to rotate the rotation shaft 45*a*. The rotational movement of the motor 45*c* is transmitted to the rotation shaft 45*a* via a driving pulley 45*d*, a timing belt 45*e*, and a driven pulley 45*f*. The holder 30 is arranged coaxially with the rotation shaft 45*a* and is rotated together with the rotation shaft 45*a*. The rotation shaft 45*a* of the holder 30 is the rotation center line R of the holder 30.

The arm 50 has, for example, a square tube shape, and accommodates the motor 45*c*, the driving pulley 45*d*, the timing belt 45*e*, and the driven pulley 45*f* therein. In addition, the arm 50 holds the bearing 45*b* of the rotation shaft 45*a*. The rotation shaft 45*a* protrudes downward from the arm 50 and holds the holder 30 at the lower end thereof. The rotation shaft 45*a* includes, for example, a shaft 45*al* on which the driven pulley 45*f* is mounted and a shaft 45*a*2 on which the holder 30 is mounted.

As illustrated in FIG. 1, the substrate processing apparatus 1 includes a liquid supplier 60 configured to supply a cleaning liquid to the substrate W held by the holding portion 12. The cleaning liquid is not particularly limited, but is, for example, deionized water (DIW). The cleaning liquid washes away particles such as polishing debris and suppresses the adhesion of particles. In addition, the cleaning liquid suppresses temperature rise due to the frictional heat between the substrate W and the polishing head 20.

The liquid supplier 60 includes a first nozzle 61 configured to eject the cleaning liquid toward the peripheral edge portion Wa of the substrate W. The first nozzle 61 supplies the cleaning liquid to the first bevel Wa1 of the substrate W from above the substrate W. The first nozzle 61 is moved together with the holder 30 by the moving mechanism 40. The first nozzle 61 is held by, for example, a bracket 51 fixed to the bottom surface of the arm 50. Since the first nozzle 61 is moved together with the holder 30, it is possible to prevent interference between the substrate W and the first nozzle 61 when the substrate W is carried in and out, and it is possible to supply the cleaning liquid toward the polishing head 20 during the polishing of the substrate W.

The liquid supplier 60 may include a second nozzle 62. The second nozzle 62 supplies the cleaning liquid to the center of the top surface of the substrate W from directly above the center of the top surface of the rotating substrate W. The cleaning liquid is spread over the entire top surface of the substrate W by a centrifugal force, washes off the particles, and is centrifugally separated from the peripheral edge of the top surface of the substrate W. The second nozzle 62 moves between a center position directly above the center of the top surface of the substrate W and a standby position for preventing interference between the substrate W and the second nozzle 62 when the substrate W is carried in and out.

In addition, the liquid supplier 60 may include a third nozzle 63. The third nozzle 63 supplies the cleaning liquid to the second bevel Wa2 of the substrate W from below the substrate W so as to prevent particles from flowing around to the bottom surface of the substrate W. Unlike the first nozzle 61 and the second nozzle 62, the third nozzle 63 does not interfere with the substrate W, and thus may not move. The third nozzle 63 is fixed with respect to the cup 17.

The substrate processing apparatus 1 includes a controller 90. The controller 90 is, for example, a computer, and includes a central processing unit (CPU) 91 and a storage medium 92 such as a memory. In the storage medium 92, a program for controlling various kinds of processing executed in the substrate processing apparatus 1 is stored. The controller 90 controls the operation of the substrate processing apparatus 1 by causing the CPU 91 to execute the program stored in the storage medium 92.

Figure 9:
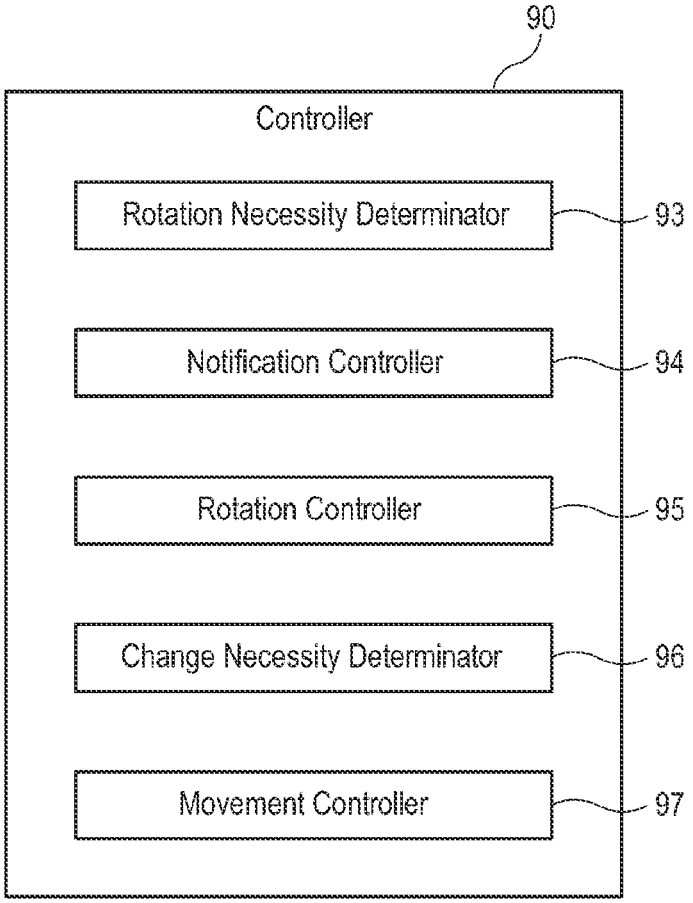
FIG. 9 is a diagram illustrating components of a control device of a substrate processing apparatus according to an embodiment as a functional block.

Next, the function of the controller 90 will be described with reference to FIG. 9. Each functional block illustrated in FIG. 9 is conceptual and does not necessarily have to be physically configured as illustrated in the figure. It is possible to configure all or part of each functional block to be functionally or physically distributed/integrated in any unit. All or any part in each processing function performed in each function block may be implemented by a program executed by a CPU, or may be implemented as hardware by wired logic. The controller 90 includes, for example, a rotation necessity determinator 93, a notification controller 94, a rotation controller 95, a change necessity determinator 96, and a movement controller 97.

The rotation necessity determinator 93 determines whether or not it is necessary to replace the polishing sheet 21 by the rotation of the holder 30. The rotation necessity determinator 93 monitors the amount of wear of the polishing sheet 21. The amount of wear of the polishing sheet 21 is represented by, for example, at least one of the use frequency and use time of the polishing sheet 21. The use frequency is the total number of the polished substrates W. The use time is the total time of contact with the substrates W. The rotation necessity determinator 93 monitors the amount of wear of the polishing sheet 21, and when the amount of wear reaches a set value, the rotation necessity determinator 93 determines that the holder 30 needs to be rotated, and that the polishing sheet 21 to be applied to the peripheral edge portions Wa of the substrates W needs to be replaced.

The notification controller 94 performs notification control for urging the rotation of the holder 30 based on the determination result of the rotation necessity determinator 93. When the rotation necessity determinator 93 determines that the holder 30 needs to be rotated, the notification controller 94 operates a notification device such as a display device or an audio device such that the notification device outputs an image or sound urging the rotation of the holder 30. When one polishing sheet 21 is worn and the life of the same expires, it is possible to manually rotate the holder 30, and thus it is possible to polish substrates W using another polishing sheet.

The rotation controller 95 controls the rotation mechanism 45 of the holder 30. For example, the rotation controller 95 stops the rotation of the holder 30 while polishing the substrate W. In addition, the rotation controller 95 rotates the holder 30 based on the determination result of the rotation necessity determinator 93. When the rotation necessity determinator 93 determines that the holder 30 needs to be rotated, the rotation controller 95 rotates the holder 30. When one polishing sheet 21 is worn and the life of the same expires, it is possible to automatically rotate the holder 30, and thus it is possible to polish the substrates W using another polishing sheet 21.

The change necessity determinator 96 determines whether or not it is necessary to change the polishing position of the holder 30. The change necessity determinator 96 manages one polishing sheet 21 by dividing it into multiple management areas, and monitors the amount of wear in each management area. One management area selected from the multiple management areas is brought into contact with the peripheral edge portions Wa of the substrates W. The change necessity determinator 96 monitors the amount of wear in the management area applied to the substrates W. and when the amount of wear reaches a set value, the change necessity determinator 96 determines that it is necessary to replace the management area applied to the substrates W and that it is necessary to change the polishing position.

The movement controller 97 controls the moving mechanism 40 of the holder 30. For example, the movement controller 97 moves the holder 30 between the polishing position and the standby position. In addition, the movement controller 97 changes the polishing position based on the determination result of the change necessity determinator 96. When the change necessity determinator 96 determines that the polishing position needs to be changed, the movement controller 97 changes the polishing position. When one management area is worn and the life of the same expires, it is possible to polish the substrates W in another management area by changing the polishing position even when the polishing sheet 21 is not replaced, and thus it is possible to use the entire polishing sheet 21 without waste.

When the amount of wear in all of the management areas of one polishing sheet 21 reaches the set value, the rotation necessity determinator 93 determines that the holder 30 needs to be rotated. Finally, when the amount of wear in all of the management areas of multiple polishing sheets 21 arranged in rotational symmetry reaches a set value, the polishing head 20 is replaced.

Figure 10:
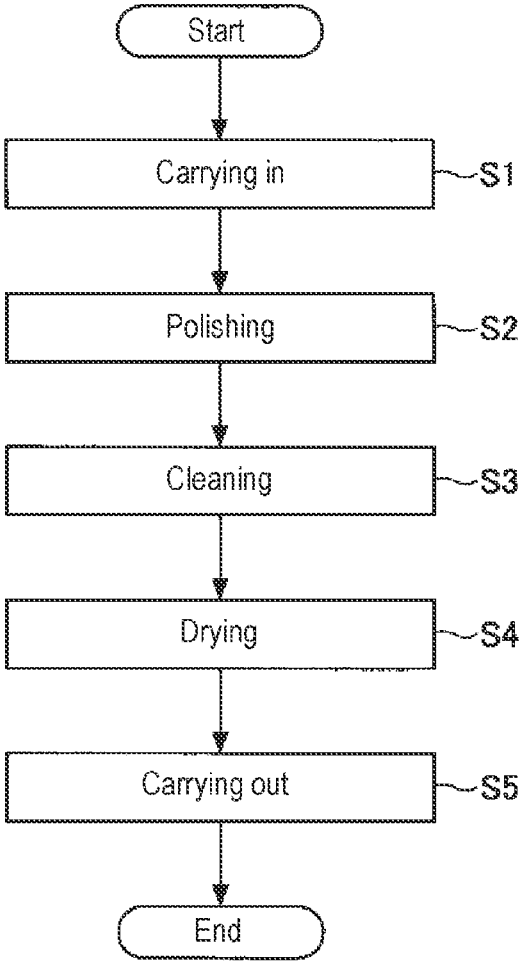
FIG. 10 is a flowchart illustrating a substrate processing method according to an embodiment.

Next, a substrate processing method will be described with reference to FIGS. 10 and 11. Steps S1 to S5 illustrated in FIG. 10 are performed under the control of the controller 90.

First, in step S1, a transport apparatus (not illustrated) carries the substrate W into the processing container 11. After the substrate W is placed on the holding portion 12, the transporting apparatus exits from the inside of the processing container 11. The holding portion 12 receives the substrate W from the transport apparatus and holds the substrate W.

Figure 11:
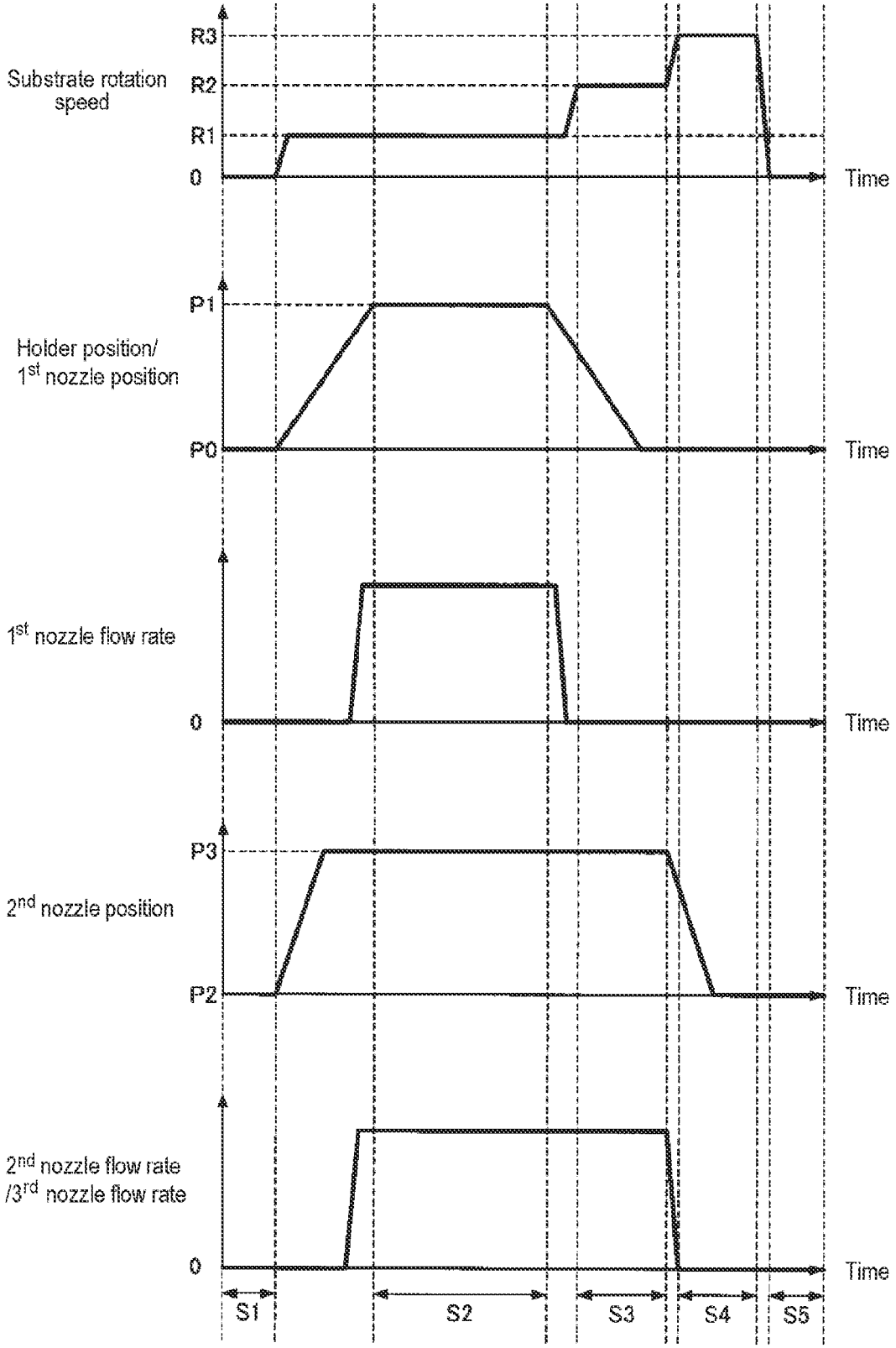
FIG. 11 is a timing chart illustrating a substrate processing method according to an embodiment.

After step S1 and before step S2, as illustrated in FIG. 11, the rotator 13 rotates the holding portion 12 and hence rotates the substrate W. The second nozzle 62 is moved from the standby position P2 to the center position P3, and subsequently supplies a cleaning liquid to the center of the top surface of the substrate W. In addition, the third nozzle 63 supplies a cleaning liquid from below the substrate W to the peripheral edge portion Wa of the substrate W. In addition, the moving mechanism 40 moves the holder 30 from the standby position P0 to the polishing position P1. The moving mechanism 40 moves the first nozzle 61 together with the holder 30.

Next, in step S2, in the state in which the moving mechanism 40 stops the holder 30 at the polishing position P1, the polishing head 20 is brought into contact with the peripheral edge portion Wa of the substrate W and polishes the peripheral edge portion Wa of the substrate W. In the meantime, the first nozzle 61 supplies the cleaning liquid from above the substrate W to the peripheral edge portion Wa of the substrate W. As long as the cleaning liquid is collected in the cup 17, as illustrated in FIG. 11, the first nozzle 61 may supply the cleaning liquid to the polishing head 20 even before the holder 30 reaches the polishing position P1.

In step S2, the polishing of the first bevel Wa1 and the polishing of the end surface Wa3 may be performed in order. The order is not particularly limited, and the first bevel Wa1 may be polished first, or the end surface Wa3 may be polished first. The polishing position P1 is set separately for the polishing of the first bevel Wa1 and the polishing of the end surface Wa3.

After step S2 and before step S3, as illustrated in FIG. 11, the moving mechanism 40 moves the holder 30 from the polishing position P1 toward the standby position P0. As a result, the polishing head 20 is separated from the peripheral edge portion Wa of the substrate W. Thereafter, the first nozzle 61 stops the ejection of the cleaning liquid. In addition, after step S2 and before step S3, the rotator 13 increases the rotation speed of the holding portion 12 from the first rotation speed R1 to the second rotation speed R2.

Next, in step S3, the second nozzle 62 supplies the cleaning liquid to the center of the top surface of the substrate W, and the third nozzle 63 supplies the cleaning liquid from below the substrate W to the peripheral edge portion Wa of the substrate W so as to wash away particles adhering to the substrate W. In step S3, since the rotation speed of the substrate W is higher than that in step S2, the centrifugal force is large and the particles are easily washed away. However, the rotation speed of the substrate W may be the same in steps S3 and S2.

After step S3 and before step S4, as illustrated in FIG. 11, the second nozzle 62 stops the ejection of the cleaning liquid, and is moved from the center position P3 to the standby position P2. In addition, the third nozzle 63 stops the ejection of the cleaning liquid. In addition, after step S3 and before step S4, the rotator 13 increases the rotation speed of the holding portion 12 from the second rotation speed R2 to the third rotation speed R3.

Next, in step S4, the rotator 13 rotates the substrate W so as to centrifugally remove the cleaning liquid remaining on the substrate W and dry the substrate W. In step S4, since the rotation speed of the substrate W is higher than that in step S3, the centrifugal force is large, and it is easy to dry the substrate W. However, the rotation speed of the substrate W may be the same in steps S4 and S3.

After step S4 and before step S5, as illustrated in FIG. 11, the rotator 13 stops the rotation of the substrate W.

Finally, in step S5, the holding portion 12 releases the holding of the substrate W, and then a transport apparatus (not illustrated) receives the substrate W from the holding portion 12 and carries the received substrate W out of the processing container 11. Thereafter, this process is terminated.

After carrying out the substrate W and before carrying in the next substrate W, the change necessity determinator 96 determines whether or not the polishing position P1 of the holder 30 needs to be changed. When the change necessity determinator 96 determines that the polishing position P1 needs to be changed, the movement controller 97 changes the polishing position P1. The changed polishing position P1 is stored in the storage medium 92, and is read out and used when the next substrate W is polished.

In addition, after the substrate W is carried out and before the next substrate W is carried in, the rotation necessity determinator 93 determines whether or not the polishing sheet 21 needs to be replaced through the rotation of the holder 30. When the rotation necessity determinator 93 determines that the holder 30 needs to be rotated, the rotation controller 95 rotates the holder 30. Alternatively, when the rotation necessity determinator 93 determines that the holder 30 needs to be rotated, the notification controller 94 outputs an image or sound urging the rotation of the holder 30. In the latter case, the next substrate W is prevented from being carried in until the holder 30 is rotated.

Although the embodiments of the substrate processing apparatus, the polishing head, and the substrate processing method according to the present disclosure have been described above, the present disclosure is not limited to the above-described embodiments. Various changes, modifications, substitutions, additions, deletions, and combinations can be made within the scope of the claims. Of course, these also fall within the technical scope of the present disclosure.

According to an aspect of the present disclosure, it is possible to effectively remove strong deposits such as an unnecessary film deposited on the peripheral edge portions of the substrates.

While certain embodiments have been described, these embodiments have been presented by way of example only, and are not intended to limit the scope of the disclosures. Indeed, the embodiments described herein may be embodied in a variety of other forms. Furthermore, various omissions, substitutions, and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A substrate processing apparatus comprising:

a holding portion configured to hold a substrate including a bevel and an end surface in a peripheral edge portion of the substrate;

a rotator configured to rotate the holding portion;

a polishing head configured to be brought into contact with the peripheral edge portion of the substrate held by the holding portion and to polish the peripheral edge portion of the substrate; and a holder to which the polishing head is installed, wherein the holder is rotatable, and rotation of the holder is stopped during polishing of the substrate, wherein the polishing head includes a plurality of polishing sheets including abrasive grains and a polishing block including a plurality of flat surfaces, wherein the flat surfaces are arranged rotationally symmetrically about a rotation center line of the holder, wherein the polishing sheets are fixed to the flat surfaces, respectively, so that the polishing sheets are arranged rotationally symmetrically about the rotation center line of the holder, and wherein one of the polishing sheets is brought into contact with the peripheral edge portion of the substrate.

2. The substrate processing apparatus of claim 1, wherein the polishing block includes a pyramid, the pyramid includes a plurality of pyramid surfaces, which are the flat surfaces, and the polishing sheets are fixed to the pyramid surfaces of the pyramid, respectively, and polish the bevel of the substrate.

3. The substrate processing apparatus of claim 1, wherein the polishing block includes a prismatic body, the prismatic body includes a plurality of side surfaces, which are the flat surfaces, and the polishing sheets are fixed to the side surfaces of the prismatic body, respectively, and polish the end surface of the substrate.

4. The substrate processing apparatus of claim 1, further comprising:

a rotation necessity determinator configured to determine whether or not a polishing sheet, which is to be applied to the peripheral edge portion of the substrate, among the polishing sheets needs to be replaced by the rotation of the holder, and a notification controller configured to perform a notification control that urges the rotation of the holder based on a determination result of the rotation necessity determinator.

5. The substrate processing apparatus of claim 1, further comprising:

a rotation mechanism configured to rotate the holder around the rotation center line;

a rotation controller configured to control the rotation mechanism; and a rotation necessity determinator configured to determine whether or not a polishing sheet, which is to be applied to the peripheral edge portion of the substrate, among the polishing sheets needs to be replaced by the rotation of the holder, wherein the rotation controller rotates the holder based on a determination result of the rotation necessity determinator.

6. The substrate processing apparatus of claim 1, further comprising:

a moving mechanism configured to move the holder between a polishing position at which the polishing head is brought into contact with the peripheral edge portion of the substrate and a standby position for preventing interference between the substrate and the holder during carry-in and carry-out of the substrate;

a movement controller configured to control the moving mechanism; and a change necessity determinator configured to determine whether or not it is necessary to change the polishing position of the holder, wherein the movement controller changes the polishing position of the holder based on a determination result of the change necessity determinator.

7. The substrate processing apparatus of claim 1, wherein the polishing head further includes a plurality of flexible sheets arranged between the polishing sheets and the polishing block.

8. The substrate processing apparatus of claim 1, further comprising: a fixture configured to allow the polishing head to be replaceably installed to the holder.

9. The substrate processing apparatus of claim 1, further comprising:

a liquid supplier configured to supply a cleaning liquid to the substrate held by the holding portion, wherein the liquid supplier includes a nozzle configured to eject the cleaning liquid toward the peripheral edge portion of the substrate, and the nozzle is moved together with the holder.

10. A polishing head for polishing a peripheral edge portion of a substrate including a bevel and an end surface in the peripheral edge portion of the substrate, the polishing head comprising:

a plurality of polishing sheets including abrasive grains; and a polishing block including a plurality of flat surfaces, wherein the polishing head is installed to a holder, the holder is rotatable, and rotation of the holder is stopped during polishing of the substrate, wherein the flat surfaces are arranged rotationally symmetrically about a rotation center line of the holder, and wherein the polishing sheets are fixed to the flat surfaces, respectively, so that the polishing sheets are arranged rotationally symmetrically about the rotation center line of the holder, and one of the polishing sheets is brought into contact with the peripheral edge portion of the substrate.

11. The polishing head of claim 10, wherein the polishing block includes a pyramid, the pyramid includes a plurality of pyramid surfaces, which are the flat surfaces, and the polishing sheets are fixed to the pyramid surfaces of the pyramid, respectively, and polish the bevel of the substrate.

12. The polishing head of claim 10, wherein the polishing block includes a prismatic body, the prismatic body includes a plurality of side surfaces, which are the flat surfaces, and the polishing sheets are fixed to the side surfaces of the prismatic body, respectively, and polish the end surface of the substrate.

13. The polishing head of claim 10, further comprising:

a plurality of flexible sheets arranged between the polishing sheets and the polishing block.

14. A substrate processing method comprising:

rotating a substrate including a bevel and an end surface in a peripheral edge portion of the substrate; and polishing the peripheral edge portion of the substrate using a polishing head by bringing the polishing head into contact with the peripheral edge portion of the substrate, wherein the polishing head is installed to a holder, the holder is rotatable, and rotation of the holder is stopped during polishing of the substrate, wherein the polishing head includes a plurality of polishing sheets including abrasive grains and a polishing block including a plurality of flat surfaces, wherein the flat surfaces are arranged rotationally symmetrically about a rotation center line of the holder, wherein the polishing sheets are fixed to the flat surfaces, respectively, so that the polishing sheets are arranged rotationally symmetrically about the rotation center line of the holder, and wherein one of the polishing sheets is brought into contact with the peripheral edge portion of the substrate in the act of polishing the peripheral edge portion.

* * * * *